US005258811A

United States Patent [19]

Miyake et al.

[11] Patent Number: 5,258,811

[45] Date of Patent: Nov. 2, 1993

[54] IMAGE FORMING SYSTEM AND PROCESS CARTRIDGE REMOVABLY MOUNTABLE ON SAME

[75] Inventors: Hiroaki Miyake; Hiroo Kobayashi, both of Yokohama; Yoshiya Nomura, Tokyo, all of Japan

[73] Assignee: Canon Kabushiki Kaisha, Tokyo, Japan

[21] Appl. No.: 843,598

[22] Filed: Feb. 28, 1992

[30] Foreign Application Priority Data

Mar. 1, 1991 [JP] Japan ..... 3-036170

[51] Int. Cl.[5] ..... G03G 13/00

[52] U.S. Cl. ..... 355/210; 355/245

[58] Field of Search ..... 355/200, 210, 211, 245, 355/246, 260

[56] References Cited

U.S. PATENT DOCUMENTS

| | | | |
|---|---|---|---|
| 3,953,121 | 4/1976 | Reichart, Jr. | 355/245 |
| 4,421,401 | 12/1983 | Kagiura et al. | 355/285 |
| 4,685,792 | 8/1987 | Iseki et al. | 355/309 |
| 4,794,420 | 12/1988 | Ohashi et al. | 355/308 |
| 4,814,816 | 3/1989 | Idenawa | 118/657 X |
| 4,862,209 | 8/1989 | Sakamoto et al. | 355/211 |
| 4,862,212 | 8/1989 | Tanzawa et al. | 355/260 X |
| 4,941,015 | 7/1990 | Komai et al. | 355/200 |
| 4,969,010 | 11/1990 | Tamura et al. | 355/75 |
| 5,023,660 | 6/1991 | Ebata et al. | 355/200 |
| 5,027,152 | 6/1991 | Oda et al. | 355/200 |
| 5,028,966 | 7/1991 | Kozuka et al. | 355/260 |
| 5,126,800 | 6/1992 | Shishido et al. | 355/211 |
| 5,153,640 | 10/1992 | Okabe | 355/200 |

OTHER PUBLICATIONS

European Search Report, EP 92 10 3403.

*Primary Examiner*—Leo P. Picard
*Assistant Examiner*—Christopher Horgan
*Attorney, Agent, or Firm*—Fitzpatrick, Cella, Harper & Scinto

[57] ABSTRACT

An image forming system having an image bearing member and a developer bearing member. Developer bearing member is biased toward the image bearing member by using the weight of a developing device. A tension spring for reducing an urging force of the developer bearing member against the image forming member is provided.

14 Claims, 4 Drawing Sheets

IMAGE FORMING SYSTEM AND PROCESS CARTRIDGE REMOVABLY MOUNTABLE ON SAME

BACKGROUND OF THE INVENTION

1. Field of the Invention

The present invention relates to an image forming system wherein an electrostatic latent image is formed on an image bearing member and then is developed, and a process cartridge including the image bearing member and a developing device therein and removably mountable on the image forming system.

2. Related Background Art

In an image forming system such as an electrophotographic system and the like, in order to keep constant a distance between an image bearing member and a developer bearing member for supplying developer to the image bearing member, spacers formed on a developing device are abutted against the image bearing member. More particularly, the developing device is pivotally mounted on a shaft, and the spacers are urged against the image bearing member by utilizing a moment generated around the shaft due to the gravity force acting on the developing device.

In such an image forming system, if the gravity force (weight) of the developing device is increased, the urging force of the spacers against the image bearing member will also increase, thereby damaging the image bearing member and(or) spacers.

Recently, image forming systems wherein a process cartridge including an image bearing member and a developing device supported by a common supporting means is removably mounted on the image forming system have widely been used.

In such a process cartridge, as the service life of the image bearing member is extended, the capacity of the developer container of the developing device has been increased. However, when the capacity of the developer container of the developing device is increased, the weight of the developing device is also increased, thus causing the above problem. Consequently, the process cartridge inconvenient must be exchanged for a new one (due to the damage of its image bearing memebr and(or) spacers) even when the photosensitivity of the image bearing member is not yet deteriorated and an adequate amount of developer still remains within the developing device.

Further, since the above-mentioned common supporting means of the process cartridge is generally molded from synthetic resin, the mechanical rigidity thereof is so small as to easily deform the supporting means. Further, in general, a gear for transmitting a rotational driving force to the developer bearing member is disposed at one of the longitudinal sides of the developing device. In this case, when a driving force is applied to the gear, a greater load acts on that one longitudinal side of the developing device in comparison with the other longitudinal side of the developing device, thus torsionally deforming the supporting means. Such torsional deformation of the supporting means is inconvenient in that the urging force of the spacers against the image bearing member at one longitudinal side of the developing device differs from the urging force at the other longitudinal side of the developing device, thereby causing a difference in the density of the image developed on the image bearing member from the one side (left) to the other side (right).

SUMMARY OF THE INVENTION

An object of the present invention is to provide an image forming system and a process cartridge, wherein a biasing force of a developing device directing toward an image bearing member is relatively weak even when the weight of the developing device is increased.

Another object of the present invention is to prevent damage to an image bearing member and(or) spacers, by reducing an abutting force between the image bearing member and the spacers, even when the weight of a developing device is increased.

A further object of the present invention is to reduce the difference in an urging force between two spacers.

Other objects and features of the present invention will be apparent from the following explanation.

DESCRIPTION OF THE PREFERRED EMBODIMENTS

Figure 5:
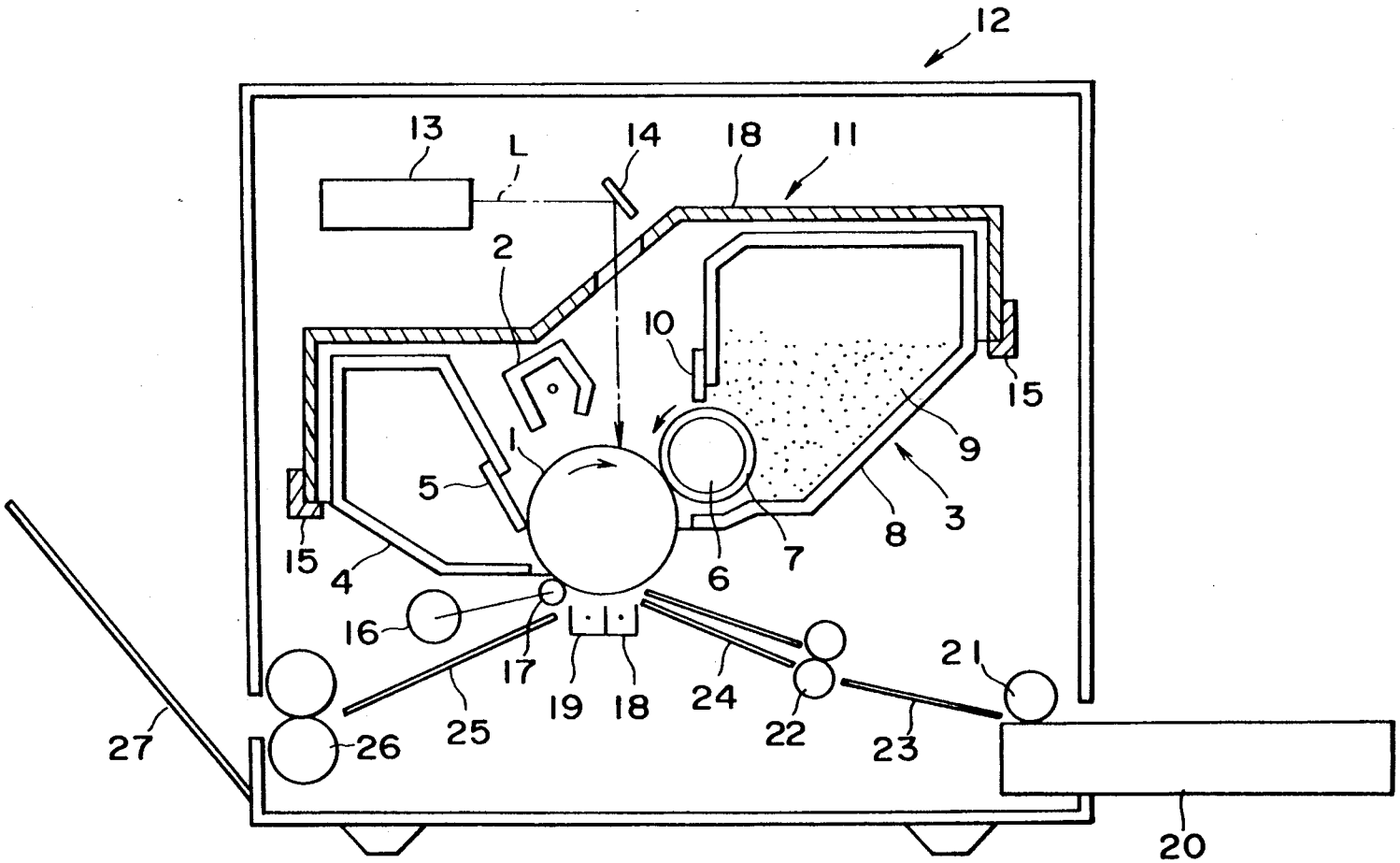
FIG. 5 is an elevational sectional view of an image forming system according to a preferred embodiment of the present invention.

In FIG. 5, an image forming system 12 comprises an optical device, a transfer sheet feeding apparatus, a transferring device, a fixing device, guide members 15 for guiding a process cartridge 11 along a direction perpendicular to a plane of FIG. 5 during the mounting and dismounting of the process cartridge with respect to the image forming system (vertical to sheet face of FIG. 5) and a motor 16 and a gear 17 for driving a photosensitive member 1 and a developing roller 6 in the process cartridge, which will be fully described later.

The process cartridge 11 includes the above-mentioned drum-shaped photosensitive member 1 rotated in a predetermined direction, a charger 2 for uniformly charging the photosensitive member 1, a developing device 3 for developing an electrostatic latent image formed on the photosensitive member 1, and a cleaning container 4 having a cleaning blade 5 for removing residual toner remaining on the surface of the photosensitive member 1 after a developed image has been transferred. These elements are supported within a frame 18 molded from synthetic resin.

The process cartridge 11 can be slidingly moved along the guide members 15 to be inserted into or removed from the image forming system. Thus, for example, when the toner in the developing device 3 is depleted by use, an operator can remove the process cartridge 11 from the image forming system 12, and can insert a new process cartridge 11 having a developing device including a container 8 fully loaded with toner into the image forming system. Further, when a process cartridge having a developing device including a desired color toner is inserted into the image forming system, a desired color image can be outputted.

The developing device 3 comprises a toner container 8 containing the toner 9 as developer, and a developing roller 6 rotatably mounted on the toner container 8. The developing roller 6 carries the toner in the toner container thereon, and conveys the toner while rotating in a direction shown by the arrow to apply the toner to the electrostatic latent image formed on the photosensitive member 1, thus developing the latent image.

Figure 3:
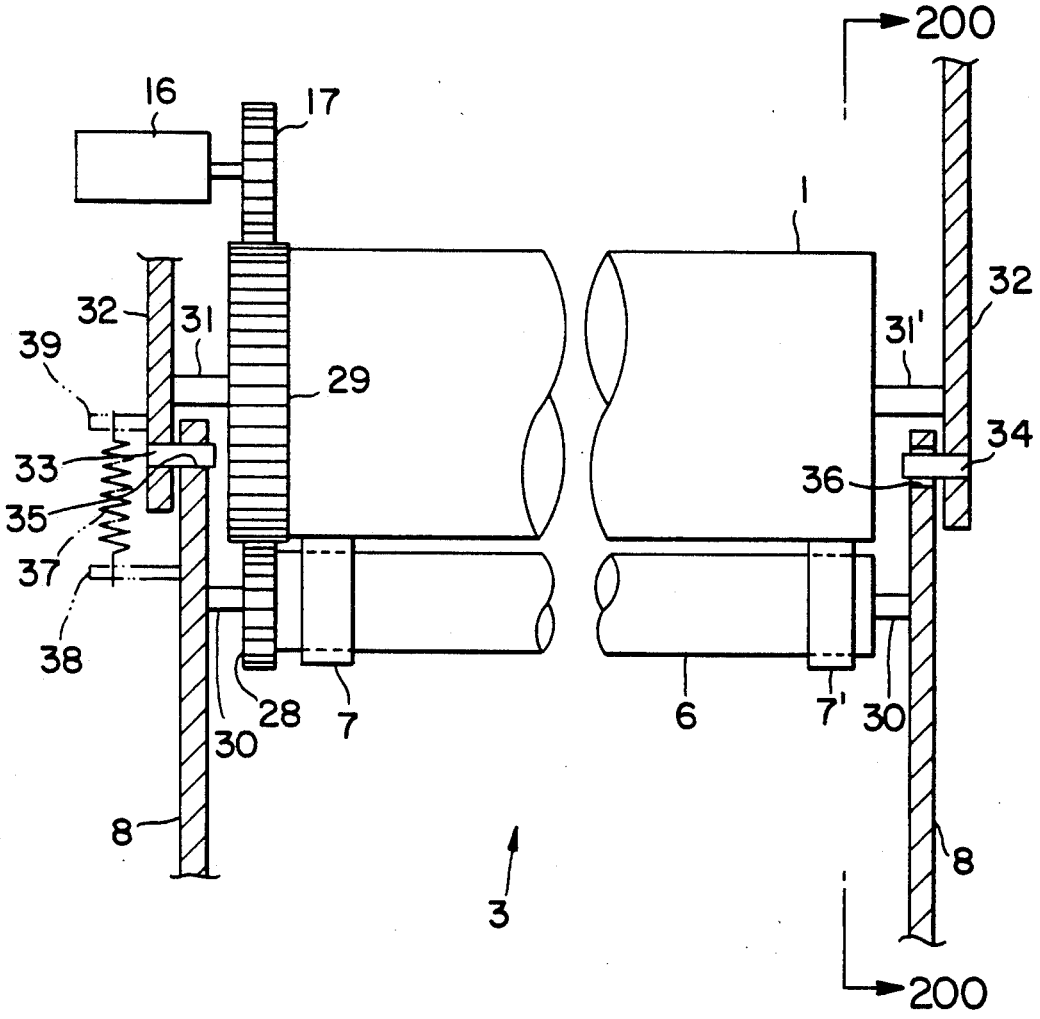
FIG. 3 is a sectional view of the process cartridge taken along the line 300—300 of FIGS. 1 and 2.

A minimum distance maintained between the developing roller 6 and the photosensitive member 1 at a developing zone is 50 μm to 400 μm. At the developing zone, a thin layer of developer (toner layer) having a thickness smaller than the above-mentioned minimum distance is formed on the developing roller 6 so that a so-called "non-contact" type development can be effected. The thickness of the toner layer is regulated by a doctor blade 10. Further, as shown in FIG. 3, on respective longitudinal end portions of the developing roller 6, a pair of thin annular spacers 7, 7' are press-fitted on the developing roller 6 coaxially with the latter. By abutting these spacers 7, 7' against respective longitudinal end portions of the photosensitive member 1, the above-mentioned minimum distance is defined between the roller 6 and the photosensitive member 1. In place of these spacers, a pair of spacer rollers may be press-fitted on respective end shafts 30, 30' of the developing roller 6.

Next, an image forming operation will be explained. The photosensitive member 1 is first charged by the charger 2. Then, an electrostatic latent image is formed on the photosensitive member by scanning and exposing with a laser beam L modulated in response to an image information signal. The laser beam L is generated by a conventional optical device including a semi-conductor laser, a rotary polygonal mirror, an f-$\theta$ lens and the like, and is reflected toward the photosensitive member 1 by means of a mirror 14.

As mentioned above, the electrostatic latent image is developed by the developing device 3 to obtain a toner image. The toner image so obtained is transferred onto a transfer sheet such as paper by the action of a transfer charger 18. Thereafter, the transfer sheet is separated from the photosensitive member 1 by the action of a separating discharger 19.

The transfer sheet feeding apparatus comprises a cassette 20 containing transfer sheets therein, a pick-up roller 21 for sequentially feeding out transfer sheets from the cassette 20, registration rollers 22 for conveying the transfer sheets to a transferring zone synchronous with the movement of the toner image, and conveying guides 23, 24, 25.

The transfer sheet separated from the photo-sensitive member 1 is sent to a fixing device 26 through the guide 25, where the toner image is fixed to the transfer sheet. After fixing, the transfer sheet is ejected onto an ejection tray 27.

As illustrated in the present embodiment, the photosensitive member 1 was exposed by a laser beam. However, the photosensitive member 1 may be exposed by radiation emitted from a luminous diode array driven in response to the image information signal or may be exposed by illuminating the light image on the photosensitive member via lenses.

Incidentally, as shown in FIG. 3, a second gear 29 is fixed to one end of the drum-shaped photosensitive member 1 coaxially therewith, and a first gear 28 is fixed to one end (with respect to a longitudinal direction of the developing device) of the developing roller 6 coaxially therewith. The second gear 29 is positioned outside the developing device. The first and second gears 28, 29 are meshed with each other so that the photosensitive member or drum 1 and the developing roller 6 can be driven synchronous with each other.

When the process cartridge 11 is inserted along the guides 15 and is positioned in place within the image forming system, the second gear 29 is engaged by a gear 17 rotatingly driven by the motor 16. Consequently, the drum 1 is rotatingly driven, and the developing roller 6 is rotated in a direction opposite to that of the drum 1 by the first gear 28 to which the rotational driving force is transmitted from the second gear 29.

In the present embodiment, a process cartridge having the cleaning container 4 and the charger 2 as well as the drum-shaped electrophotographic photosensitive member 1 and the developing device 3 was explained. However, the present invention can be applied to a process cartridge which has a photosensitive member and a developing device but does not have a cleaning device and(or) a charger.

Figure 1:
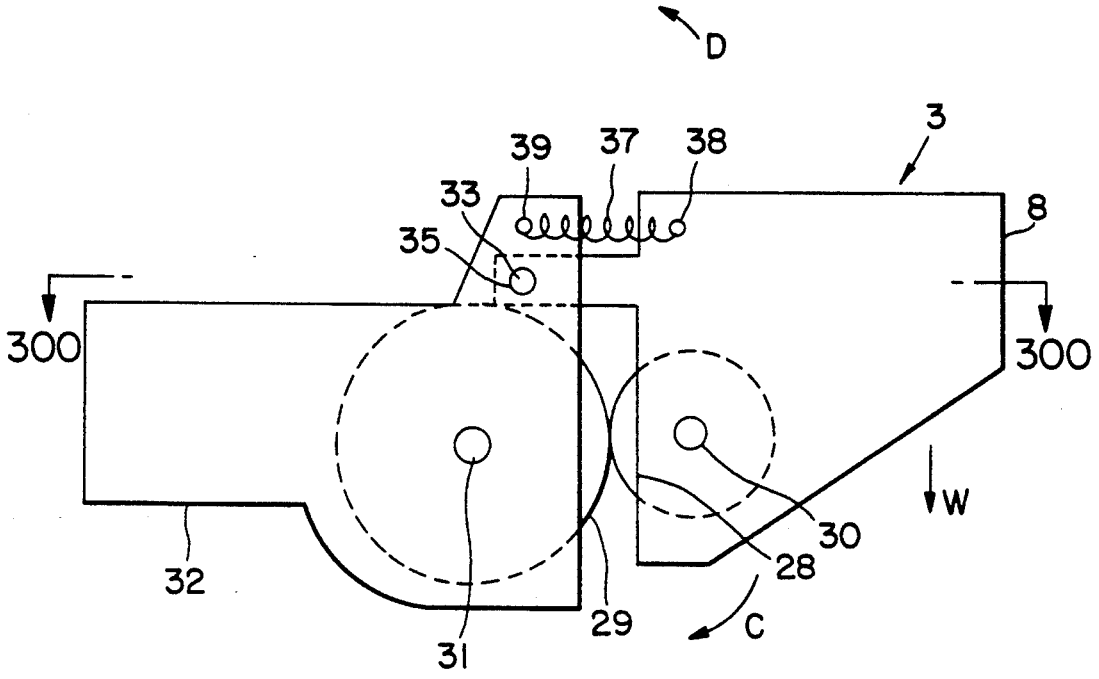
FIG. 1 is an elevational view of a main portion of a process cartridge to which the present invention is applied.
Figure 2:
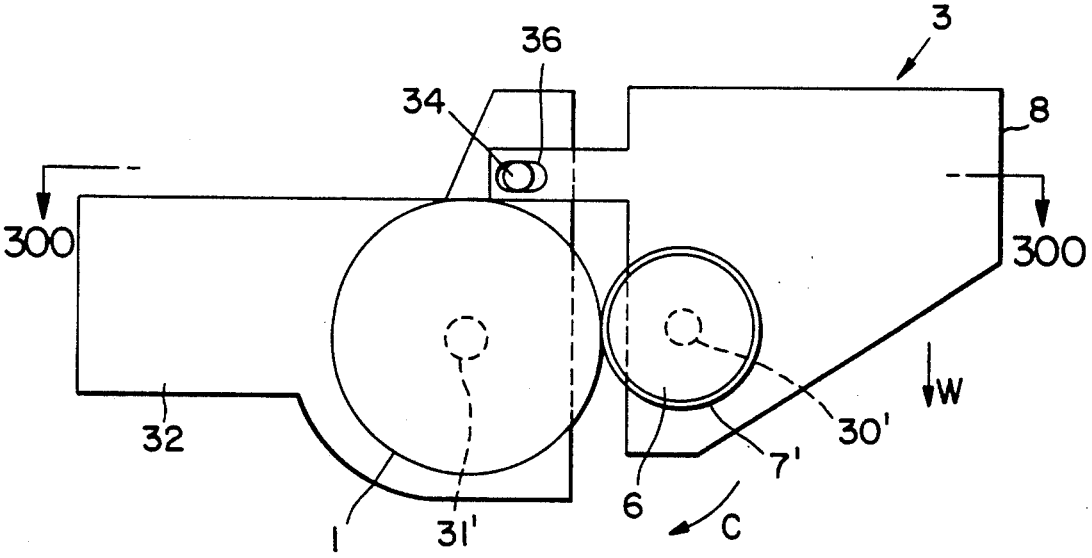
FIG. 2 is a sectional elevational view of the process cartridge taken along the line 200—200 of FIG. 3.

In FIGS. 1 to 3, end shafts 31, 31' of the drum-shaped photosensitive member 1 are rotatably supported by a support frame 32 molded from synthetic resin. Incidentally, in the illustrated embodiment, the cleaning container 4 is also supported by the support frame 32 which is, in turn, secured to the frame 18 shown in FIG. 1.

The end shafts 30, 30' of the developing roller 6 are rotatably supported by the toner container 8 molded from synthetic resin.

At one of the longitudinal sides of the developing device 3, i.e., the side at which the first gear 28 is disposed, the toner container 8 is pivotally mounted on a shaft 33 secured to the frame 32. On the other hand, at the other longitudinal side of the developing device 3, the container 8 is pivotally mounted on a shaft 34 secured to the frame 32. Accordingly, the developing device 3 can be rocked around the shaft 33, 34 toward and away from the photosensitive member 1. Shafts 33, 34 preferably exist on a common line extending in parallel with the end shafts of the developing roller 6.

A moment generated around the fulcrums, i.e., shafts 33, 34, due to the gravity force W acting on the developing device 3 tends to bias the developing roller 6 toward the photosensitive member 1, thus urging the spacers 7, 7' against the photosensitive member 1. The shafts 33, 34 are positioned to generate such a moment.

Figure 4:
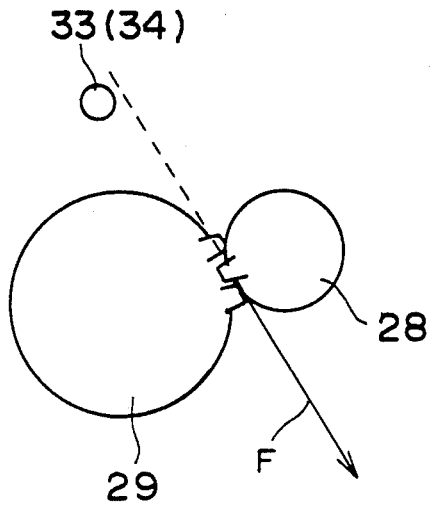
FIG. 4 is a view for explaining the relation between a force in a direction of a pressure angle of a meshing point of gears and a position of a support means.

Further, when the second gear 29 is rotated and transmits its driving force to the first gear 28, as show in FIG. 4, the first gear 28 is subjected to a force F (from the second gear 29) acting in a direction of a pressure angle of a meshing point between the gears. This force F also generates a moment around the fulcrums, i.e., shafts 33, 34, which moment tends to bias the developing roller 6 toward the photosensitive member 1 to urge the spacers 7, 7' against the photosensitive member 1. In other wards, the shafts 33, 34 are also positioned to generate such a moment due to the force F.

A hole 35 formed in the container 8 is fitted to the shaft 33 and has substantially the same diameter as that of the shaft 33. Accordingly, at the side where the gear 28 is disposed, i.e., at a side where the developing roller 6 is subjected to the rotational driving force, the developing device 3 can not be shifted with respect to the shaft 33 in the longitudinal direction of the developing device.

On the other hand, an elongated slot 36 formed in the container 8 is fitted to the shaft 34 and has a width substantially the same as the diameter of the shaft 34 and a length greater than the diameter. The longitudinal direction of the slot 36 coincides with a direction which intersects the direction of the gravity force W and along a direction in which the other side of the developing roller 6 (i.e., the side where the gear 28 is not disposed) is displaced toward and away from the photosensitive member 1. In any case, since the slot 36 is elongated, the other side of the developing device 3 (i.e., the side where the gear 28 is not disposed) can be shifted slightly with respect to the photosensitive member 1 in a direction perpendicular to the longitudinal direction of the developing device 3.

With the arrangement as mentioned above, a distance between a pitch circle of the first gear 28 and that of the second gear 29 is exactly maintained to a desired value, and, it is ensured that not only the spacer 7 but also the spacer 7' are surely abutted against the photosensitive member 1. That is to say, the positioning of the developing device 3 with respect to the photosensitive member 1 is effected by the fulcrum means comprising the shaft 33 and the hole 35, and the two spacers 7, 7'.

Figure 6:
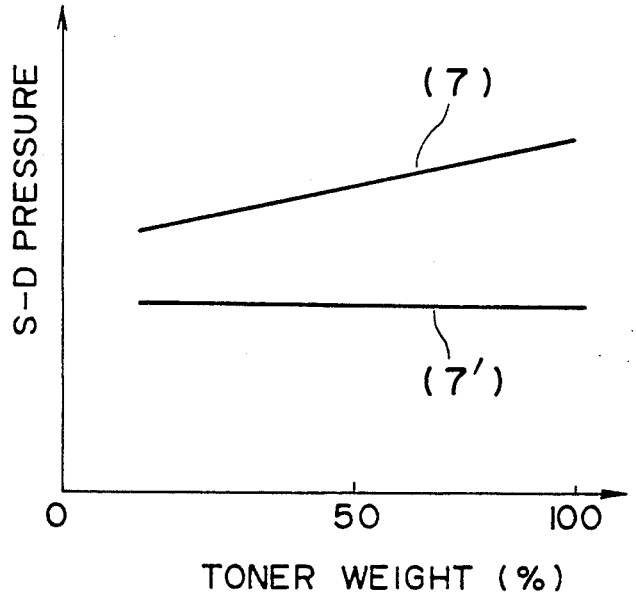
FIG. 6 is a graph for explaining the S - D pressure.

In the above-mentioned arrangement, test results illustrating the difference in a pressure between o the photosensitive member 1 and the spacer 7 or 7' (referred to as "S - D pressure" hereinafter) in response to a change in the toner amount in the container 8 are shown in FIG. 6. In FIG. 6, the coordinate indicates the S - D pressure and the abscissa indicates a percentage (%) of the residual toner amount with respect to the fully loaded toner amount in the container 8. The solid line (7) shows the S - D pressure between the spacer 7 and the photosensitive member 1, and the solid line (7') shows the S - D pressure between the spacer 7' and the photosensitive member 1.

As seen from FIG. 6, the S - D pressure (7) regarding the spacer 7 at the side where the first gear 28 is disposed is greater than the S - D pressure (7') regarding the spacer 7' at the other side, because the moment generated due to the force F acting in a direction of the pressure angle of the meshing point between the gears as shown in FIG. 4 acts on the spacer 7 much more it acts on the spacer 7'.

Further, the S - D pressure (7) is decreased in accordance with the reduction in the toner amount in the container 8; whereas, the S - D pressure (7') does not decrease so much as the toner amount is decreased. The reason seems to be as follows. That is to say, since the supporting slot 36 disposed at the side where the spacer 7' is disposed is elongated, as the toner amount in the developing device is changes, the shaft 34 is displaced in the slot 36 along its length around the abutting point between the photosensitive member 1 and the spacer 7' as a second fulcrum, thus regulating the fluctuation in the S - D pressure (7').

In view of the above, in order to regulate the fluctuation in the S - D pressure (7), with respect to the longitudinal direction of the developing device and accordingly the developing roller, an elastic force for reducing a moment C generated around the shaft 33 due to the gravity force W is applied to the developing device 3 only at the side where the first gear 28 is disposed. That is to say, as shown in FIG. 3, there is provided a tension spring 37 having one end attached to a pin 38 formed on the container 8 and the other end attached to a pin 39 formed on the frame 32. In this way, a moment D acting in a direction opposite to the clockwise acting direction of the moment C due to the gravity force W is generated around the shaft 33 by an elastic force of the tension spring 37. However, the magnitude of the moment D should be smaller than that of the moment C at an area where the spacer 7 is abutted against the photosensitive member 1 so that the spacer 7 can be securely abutted against the photosensitive member 1 by the gravitational moment C. Further, the moment D generated due to the spring 37 acts in a direction opposite to the acting direction of the moment generated due to the force F as shown in FIG. 4, thereby reducing the urging force by which the spacer 7 is urged against the photosensitive member by the moment due to the force F.

In this way, the S - D pressures (7), (7') are reduced and are equalized, so that the percentages of reduction in the S - D pressures (7), (7') due to the reduction in the toner amount within the container 8 are equalized to each other.

By appropriately selecting the elastic force of the tension spring 37, each of the S - D pressures (7), (7') can be set to be, for example, about 1.5 kg at the fully loaded toner condition and about 0.5 kg at the empty toner condition of the container 8.

Incidentally, in the illustrated embodiment, while the shaft 33 was formed on the frame 32 and the hole 35 was formed in the container 8, the shaft 33 may be formed on the container 8 and the hole 35 may be formed in the frame 32. Similarly, the shaft 34 may be formed on the container 8 and the slot 36 may be formed in the frame 32.

Further, while the positions of the fulcrum means 33, 34 were set so that the force F acting in a direction of the pressure angle at the meshing point between the gears 28, 29 generated a moment for biasing the developing roller 6 toward the photosensitive member 1, the positions of the fulcrum means may be set so as to generate a moment acting in the opposite direction. In this case, the shaft 33 the position of the shaft 33 shown in FIG. 4 is located on the opposite side of the extension line (broken line) of the Force F, so that a moment generated around the shaft 33 due to the force F acts in the same direction as that of the moment D generated due to the spring 37, thus combining to reduce the S - D pressures (7), (7').

Further, in the illustrated embodiments, a small distance or gap was created between the developing roller and the photosensitive member by using the spacers 7, 7'. However, the present invention may be applied to a developing device wherein an elastic developing roller made of, for example, electroconductive rubber is directly urged against the photosensitive member for developing the latent image. In this case, the spacers can be omitted.

Further, although the present invention is particularly useful to a process cartridge including a developing device having a large toner containing capacity, the present invention can be applied to an image forming system on which a photosensitive member and(or) a developing device can be removably mounted individually.

What is claimed is:

1. An image forming apparatus wherein an electrostatic latent image is formed and is developed, comprising:

an image bearing member;

latent image forming means for forming an electrostatic latent image on said image bearing member;

a developing device adapted to develop the electrostatic latent image, and comprising a rotary developer bearing member for applying developer to said image bearing member, a developer containing chamber for containing the developer to be supplied to said developer bearing member, first and second spacer members provided at respective sides of said developer bearing member and arranged to abut against said image bearing member, and a first gear disposed on a first longitudinal side of said developing device for transmitting a driving force to said developer biasing member;

a second gear meshed with said first gear and adapted to transmit a driving force to said first gear;

fulcrum means for pivotally supporting said developing device, said fulcrum means supporting said developing device so that a moment biasing said developer bearing member toward said image bearing member is generated by a gravity force acting on said developing device and by a force transmitted by said second gear to said first gear in a direction of a pressure angle of a meshing point between said first gear and said second gear; and an elastic member for applying an elastic force to said developing device at said first longitudinal side to reduce a biasing action of said moment.

2. An image forming apparatus according to claim 1, wherein said fulcrum means supports said developing device so that a moment biasing said developer bearing member toward said image bearing member is generated by a force acting in a direction of a pressure angle of a meshing point between said second gear and said first gear.

3. An image forming apparatus according to claim 1, wherein said fulcrum means includes a first fulcrum portion for supporting said developing device at said first longitudinal side, and a second fulcrum portion for supporting said developing device at a second longitudinal side of said developing device, wherein said first fulcrum portion comprises a first shaft formed on one of a supporting means and said developing device, and a first engagement portion formed in the other of said supporting means and said developing device, and said second fulcrum portion comprises a second shaft formed on one of said developing device, and a second engagement portion formed in the other of said supporting means and said developing device, and said first shaft and first engagement portion are arranged to engage each other without substantial relative displacement in a direction perpendicular to a longitudinal direction of said developing device, and said second shaft and said second engagement portion are arranged to engage each other to permit a relative displacement therebetween in a direction substantially perpendicular to the longitudinal direction of said developing device.

4. An image forming apparatus according to claim 2, wherein said first gear is disposed coaxially with said developer bearing member.

5. An image forming apparatus according to claim 1, wherein said first gear is disposed coaxially with said developer bearing member.

6. A process cartridge removably mountable on an image forming apparatus having an optical means for projecting image information light, comprising:

an image bearing member on which an electrostatic latent image is formed by exposing said image bearing member by the image information light;

a developing device adapted to develop the electrostatic latent image, and comprising a rotary developer bearing member for applying developer to said image bearing member, first and second spacer members provided at respective sides of said developer bearing member, said first and second spacers being arranged to abut against said image bearing member, a first gear disposed on a first longitudinal side of said developing device for receiving a driving force to rotate said developer bearing member, and a developer containing chamber for containing the developer to be supplied to said developer bearing member;

a second gear meshed with said first gear for transmitting a driving force to said first gear;

fulcrum means for pivotally supporting said developing device, said fulcrum means supporting said developing device so that a moment biasing said developer bearing member toward said image bearing member is generated by a gravity force acting on said developing device, and by a force transmitted by said second gear to said first gear in a direction of a pressure angle of a meshing point between said first and second gears; and an elastic member for applying an elastic force to said developing device at the first longitudinal side thereof to reduce a biasing action of said moment.

7. A process cartridge according to claim 4, wherein said fulcrum means supports said developing device so that a moment biasing said developer bearing member toward said image bearing member is generated by a force acting in a direction of a pressure angle of a meshing point between said second gear and said first gear.

8. A process cartridge according to claim 6, wherein said fulcrum means includes a first fulcrum portion for supporting said developing device at said first longitudinal side thereof where said first gear is disposed, and a second fulcrum portion for supporting said developing device at a second longitudinal side of said developing device, wherein said first fulcrum portion comprises a first shaft formed on one of a supporting means and said developing device, and a first engagement portion formed in the other of said supporting means and said developing device, and said second fulcrum portion comprises a second shaft formed on one of said supporting means and said developing device, and a second engagement portion formed in the other of said supporting means and said developing device, and said first shaft and first engagement portion are arranged to engage each other without substantial relative displacement in a direction perpendicular to a longitudinal direction of said developing device, and said second shaft and said second engagement portion are arranged to engage each other to permit a relative displacement therebetween in a direction substantially perpendicular to the longitudinal direction of said developing device.

9. A process cartridge according to claim 7, wherein said first gear is disposed coaxially with said developer bearing member.

10. A process cartridge according to claim 6, wherein said first gear is disposed coaxially with said developer bearing member.

11. An image forming apparatus wherein an electrostatic latent image is formed and is developed, comprising:

an image bearing member;

latent image forming means for forming an electrostatic latent image on said image bearing member;

a developing device adapted to develop the electrostatic latent image, and comprising a rotary developer bearing member for applying developer to said image bearing member, first and second spacer members provided at respective sides of said developer bearing member and arranged to abut against said image bearing member, and a developer containing chamber for containing the developer to be supplied to said developer bearing member;

fulcrum means for pivotally supporting said developing device, said fulcrum means supporting said developing device so that a moment biasing said developer bearing member toward said image bearing member is generated by a gravity force acting on said developing device, said fulcrum means including a first fulcrum portion for supporting said developing device at a first longitudinal side thereof, and a second fulcrum portion for supporting said developing device at a second longitudinal side thereof; and an elastic member for applying an elastic force to said developing device at said first longitudinal side thereof, to reduce a biasing action of said moment, wherein said first fulcrum portion comprises a first shaft formed on one of a supporting means and said developing device, and a first engagement portion formed in the other of said supporting means and said developing device, and said second fulcrum portion comprises a second shaft formed on one of said supporting means and said developing means, and a second engagement portion formed in the other of said supporting means and said developing device, and said first shaft and first engagement portion are arranged to engage each other without substantial relative displacement in a direction perpendicular to a longitudinal direction of said developing device, and said second shaft and said second engagement portion are arranged to engage each other to permit a relative displacement therebetween in a direction substantially perpendicular to the longitudinal direction of said developing device.

12. An image forming system according to claim 11, wherein said developing device includes a first gear disposed at said first longitudinal side, for transmitting a driving force to said developer bearing member, and said image forming system includes a second gear disposed outside said developing device and adapted to transmit a driving force to said first gear.

13. A process cartridge removably mountable on an image forming apparatus having an optical means for projecting image information light, comprising:

an image bearing member on which an electrostatic latent image is formed by exposing said image bearing member by the image information light;

a developing device adapted to develop the electrostatic latent image, and comprising a rotary developer bearing member for applying developer to said image bearing member, first and second spacer members provided at respective sides of said developer bearing member and arranged to abut against said image bearing member, and a developer containing chamber for containing the developer to be supplied to said developer bearing member;

fulcrum means for pivotally supporting said developing device, said fulcrum means supporting said developing device so that a moment biasing said developer bearing member toward said image bearing member is generated by a gravity force acting on said developing device, said fulcrum means including a first fulcrum portion for supporting said developing device at a first longitudinal side thereof, and a second fulcrum portion for supporting said developing device at a second longitudinal side thereof; and an elastic member for applying an elastic force to said developing device at said first longitudinal side, to reduce a biasing action of said moment;

wherein said first fulcrum portion comprises a first shaft formed on one of a supporting means and said developing device, and a first engagement portion formed in the other of said supporting means and said developing device, and said second fulcrum portion comprises a second shaft formed on one of said supporting means and said developing device, and a second engagement portion formed in the other of said supporting means and said developing device, and said first shaft and first engagement portion are arranged to engage each other without substantial relative displacement in a direction perpendicular to a longitudinal direction of said developing device, and said second shaft and said second engagement portion are arranged to engage each other to permit a relative displacement therebetween in a direction substantially perpendicular to the longitudinal direction of said developing device.

14. A process cartridge according to claim 13, wherein said developing device includes a first gear disposed at said first longitudinal side and engaged by a second gear disposed outside said developing device to receive a driving force from said second gear, thereby rotating said developer bearing member.

* * * * *

UNITED STATES PATENT AND TRADEMARK OFFICE

CERTIFICATE OF CORRECTION

PATENT NO. 5,258,811

DATED November 2, 1993

INVENTOR(S) Hiroaki MIYAKE, ET AL.

It is certified that error appears in the above-indentified patent and that said Letters Patent is hereby corrected as shown below:

On the Title Page, Item [56] References Cited, Column 2, line 1:

Change "OTHER PUBLICATIONS
European Search Report, EP 92 10 3403." to

--FOREIGN PATENT DOCUMENTS
230733 8/1987 European Patent Office.--

Column 1

Line 44, change "inconvenient" to --inconveniently--.
Line 45, change "me-" to --member--.
Line 46, delete "membr".

Column 2

Line 7, change "directing" to --directed--.

Column 3

Line 34, change "member" to --member 1--.
Line 55, change "photo-sensitive" to --photosensitive--.

Column 4

Line 8, change "synchronous" to --synchronously--.
Line 41, change "shaft 33, 34" to --shafts 33, 34--.
Line 61, change "wards," to --words,--.

UNITED STATES PATENT AND TRADEMARK OFFICE

CERTIFICATE OF CORRECTION

PATENT NO. 5,258,811 Page 2 of 2

DATED November 2, 1993

INVENTOR(S) Hiroaki MIYAKE, ET AL.

It is certified that error appears in the above-indentified patent and that said Letters Patent is hereby corrected as shown below:

Column 5

Line 22, change "surely" to --securely--.
Line 28, delete "o".
Line 46, change "more" to --more than--.
Line 55, delete "is" (first occurrence).

Column 6

Line 41, delete "the shaft 33" (first occurrence).

Column 7

Line 14, change "biasing" to --bearing--.
Line 30, change "claim 1" to --claim 12--.

Column 8

Line 31, change "claim 4" to --claim 13--.

Column 9

Line 48, change "system" to --apparatus--

Signed and Sealed this

Twenty-first Day of June, 1994

Bruce Lehman

*Attest:*

BRUCE LEHMAN

*Attesting Officer*

*Commissioner of Patents and Trademarks*